US005548297A

United States Patent [19]

Arai

[11] Patent Number: 5,548,297

[45] Date of Patent: Aug. 20, 1996

[54] DOUBLE-CHANNEL COMMON ANTENNA

[75] Inventor: Hiroyuki Arai, Bunkyo-ku, Japan

[73] Assignees: Hiroyuki Arai, Tokyo-to, Japan; Toko Kabushiki Kaisha, Tokyo-to, Japan

[21] Appl. No.: 279,159

[22] Filed: Jul. 22, 1994

[30] Foreign Application Priority Data

Jul. 23, 1993 [JP] Japan ..... 5-203005

[51] Int. Cl.[6] ..... H01Q 1/38

[52] U.S. Cl. ..... 343/700 MS; 343/769; 343/846

[58] Field of Search ..... 343/700 MS, 769, 343/829, 846, 767, 770, 848; H01Q 1/38

[56] References Cited

U.S. PATENT DOCUMENTS 4,821,040 4/1989 Johnson et al. ..... 343/700 MS 5,006,859 4/1991 Wong et al. ..... 343/700 MS

*Primary Examiner*—Hoanganh Le

*Attorney, Agent, or Firm*—Cushman Darby & Cushman, L.L.P.

[57] ABSTRACT

The present invention relates to a compact, lightweight microstrip antenna that operates at two frequencies that are widely different. On a dielectric substrate are formed an element consisting of an annular conductive pattern, wherein a central edge side thereof is short-circuited to a ground electrode, and an element consisting of a circular conductive pattern within the annular conductive pattern. The circular conductive pattern is accommodated within the annular conductive pattern. The two antennas operate at different frequencies, with the element formed by the annular conductive pattern resonating in $TM_{11}$ mode and the element formed of the circular pattern resonating in the $TM_{01}$ mode. An antenna capable of being used in common by systems with widely different frequency bands, such as the GPS and VICS, is thus obtained.

4 Claims, 3 Drawing Sheets

DOUBLE-CHANNEL COMMON ANTENNA

BACKGROUND OF THE INVENTION

The present invention relates to a microstrip antenna and, in particular, to a double-channel common antenna that can utilize two different resonant frequencies.

PRIOR ART

Since a microstrip antenna has various advantages such as a small size and light weight, it is utilized in fields such as vehicular communications. The usual type of antenna of this sort operates at one resonant frequency, but there have been proposals to turn it into a two-frequency common antenna by means such as shaping the electrodes appropriately. Such a double-channel common antenna would be used when the frequencies used for transmission and reception are different, and it must be made to operate in the same mode for both frequencies.

A prior art double-channel common antenna is used for transmission and reception in two frequency bands that are comparatively close to each other, and both channels are made to operate in the same mode, as mentioned above. Until now, a double-channel common antenna with different frequencies operating in different modes had not been implemented.

PROBLEM TO BE SOLVED BY THE INVENTION

The different types of vehicular communications have expanded, and the frequency bands have also expanded correspondingly. For example, frequencies in the 1.5-GHz band are used by the Global Positioning System (GPS) and frequencies in the 2.5-GHz band are used by the Road Traffic Information Communications System (VICS), both of these systems being used for determining the location of a vehicle such as an automobile. Up until now, it has not been possible to use a single double-channel common antenna for both systems.

SUMMARY OF THE INVENTION

The present invention provides a double-channel common antenna that can accommodate systems having separated frequency bands that are used in the same vehicle, such as the above mentioned GPS and VICS.

MEANS OF SOLVING THE PROBLEM

The present invention solves the above described problem by forming microstrip antennas of two radiative electrodes, one annular and the other circular, and causing these radiative electrodes to operate in different resonance modes.

In other words, the present invention provides a double-channel common antenna comprising:

- a first radiant electrode provided in a circular annular shape on a surface of a dielectric substrate, wherein an edge surface on the central side thereof is short-circuited to a ground electrode formed on a rear surface of the dielectric substrate; and
- a second, circular radiant electrode provided within the inner edge of the first radiant electrode, wherein a central portion thereof is short-circuited to the ground electrode.

OPERATION

By arranging a circular patch antenna within an annular antenna, and causing these antennas to resonate in mutually different modes, it is possible to make the antennas operate at different resonant frequencies and thus provide a double-channel common antenna. Since the circular antenna can be compact when it operates in $TM_{01}$ mode, it can be accommodated within the inner tube of the annular antenna that resonates in $TM_{11}$ mode.

DESCRIPTION OF THE PREFERRED EMBODIMENT

A preferred embodiment of the present invention will be described below with reference to the accompanying drawings.

Figure 1A:
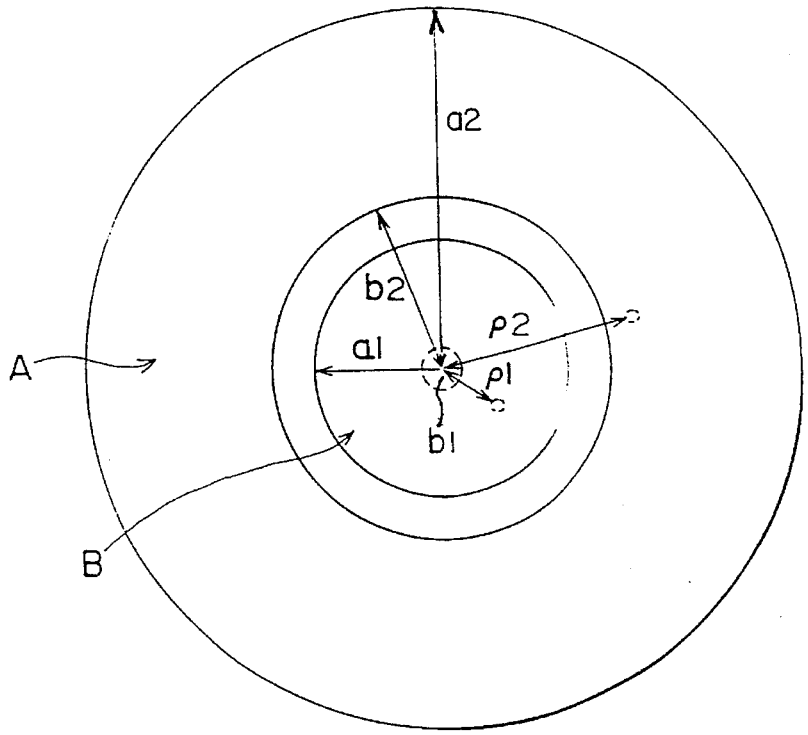
FIGS. 1(*a*) and 1(*b*) are a plan view and a lateral cross sectional view, respectively, of an embodiment of the present invention.
Figure 1B:
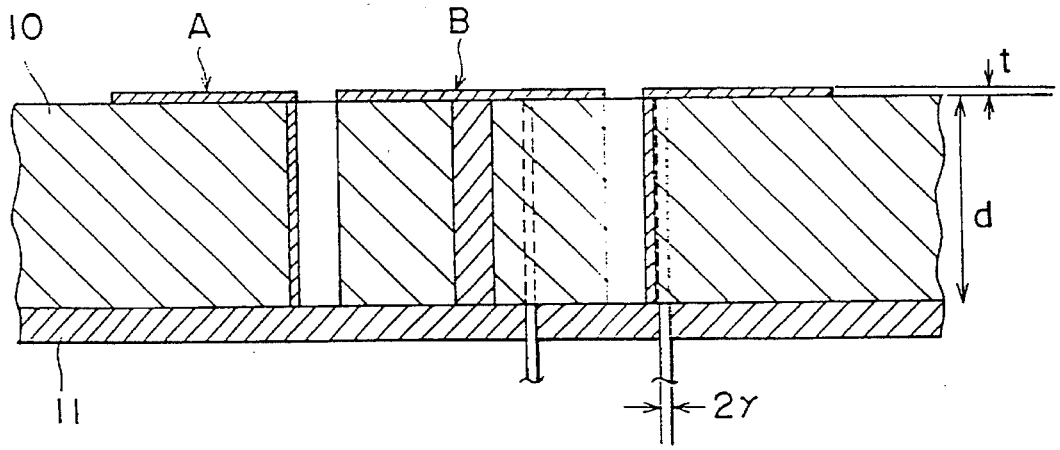

This embodiment of the double-channel common antenna in accordance with the present invention is shown in FIG. 1, with FIG. 1(*a*) being a plan view of just an electrode portion thereof and FIG. 1(*b*) being a lateral cross sectional view. An annular conductive pattern A and a circular conductive pattern B are formed on a surface of a dielectric substrate 10, in such a manner that each pattern forms a microstrip antenna with a conductive layer 11 on a rear surface that will act as a ground electrode. An edge surface on the central side of the conductive pattern A is short-circuited to the conductive layer 11 and a central portion of the conductive pattern B is similarly short-circuited to the conductive layer 11. The conductive patterns A and B are each supplied with electrical power at predetermined power supply points by coaxial cables from the rear surface of the dielectric substrate 10.

The element formed by the conductive pattern A operates in $TM_{11}$ mode and that formed by the conductive pattern B operates in $TM_{01}$ mode.

The description below concerns conductive patterns of the following dimensions formed on a dielectric substrate of thickness 5 mm and relative dielectric constant 21. The conductive bodies were configured such that the outer radius $a_2$ of the conductive pattern A was 17.9 mm, the inner radius $b_2$ thereof was 8.0 mm, the outer radius $a_1$ of the conductive pattern B was 6.2 mm, and the outer radius of the short-circuiting conductor to the conductive layer 11 was 1.0 mm. Power was supplied to the conductive pattern A at a point at a distance $p_2$ of 9.1 mm from the center thereof, and to the conductive pattern B at a point at a distance $p_1$ of 1.4 mm from the center thereof. Note that the thickness of the conductive patterns was 0.05 mm.

Figure 2A:
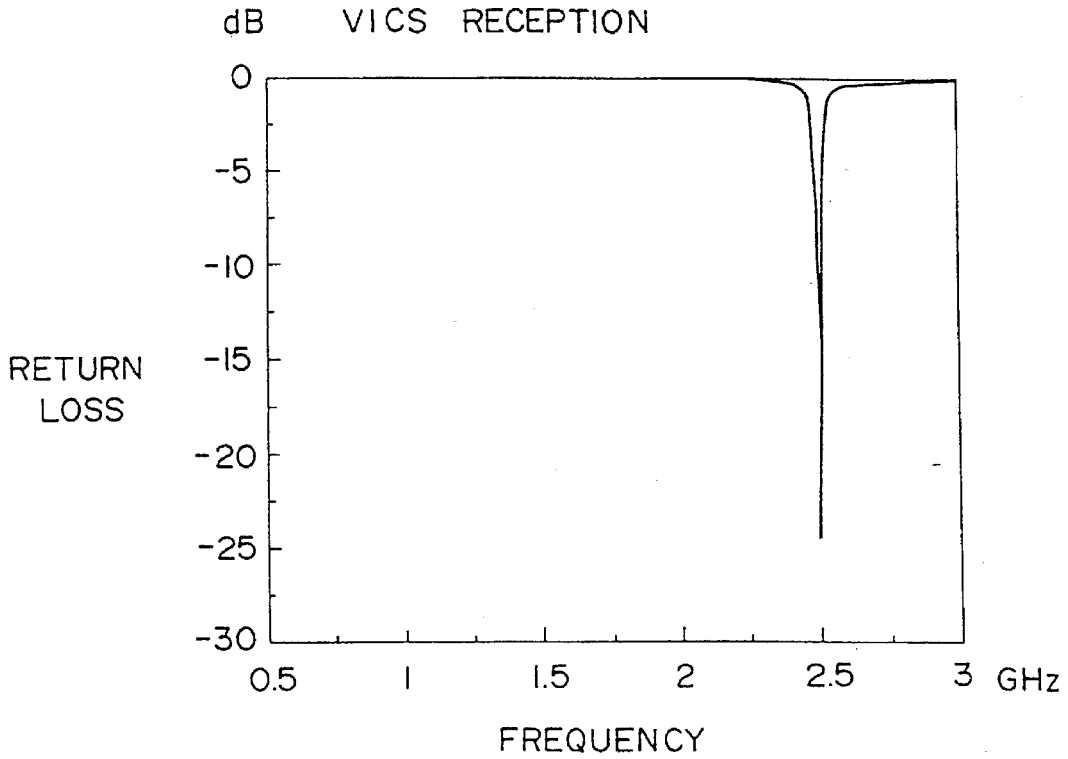
FIGS. 2(*a*) and 2(*b*) show graphs illustrative of the characteristics of the double-channel common antenna of the present invention.
Figure 2B:
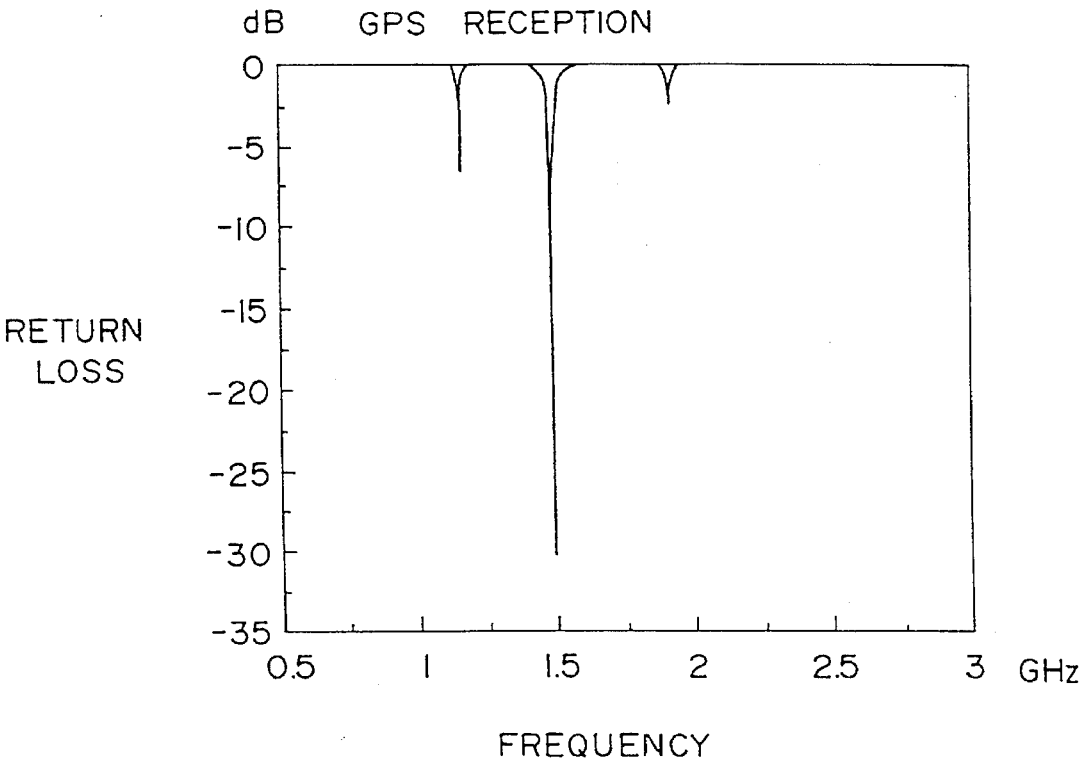

The characteristics of the double-channel common antenna configured as described above are shown in FIG. 2. FIG. 2(*a*) shows that the characteristic obtained for conductive pattern B exhibits a resonance point at 2.5 GHz, and FIG. 2(*b*) shows that the characteristic obtained for conductive pattern A exhibits a resonance point at 1.5 GHz.

The following dimensions were used for a dielectric substrate of thickness 5 mm and relative dielectric constant 37. The conductive bodies were configured such that the outer radius $a_2$ of the conductive pattern A was 15.2 mm, the inner radius $b_2$ thereof was 8.0 mm, the outer radius $a_1$ of the conductive pattern B was 4.25 mm, and the outer radius of the short-circuiting conductor to the conductive layer 11 was 1.0 mm. Power was supplied to the conductive pattern A at a point at a distance $p_2$ of 8.7 mm from the center thereof, and to the conductive pattern B at a point at a distance $p_1$ of 1.3 mm from the center thereof. Note that the thickness of the conductive patterns was 0.05 mm, in the same manner as in the previous example.

Figure 3:
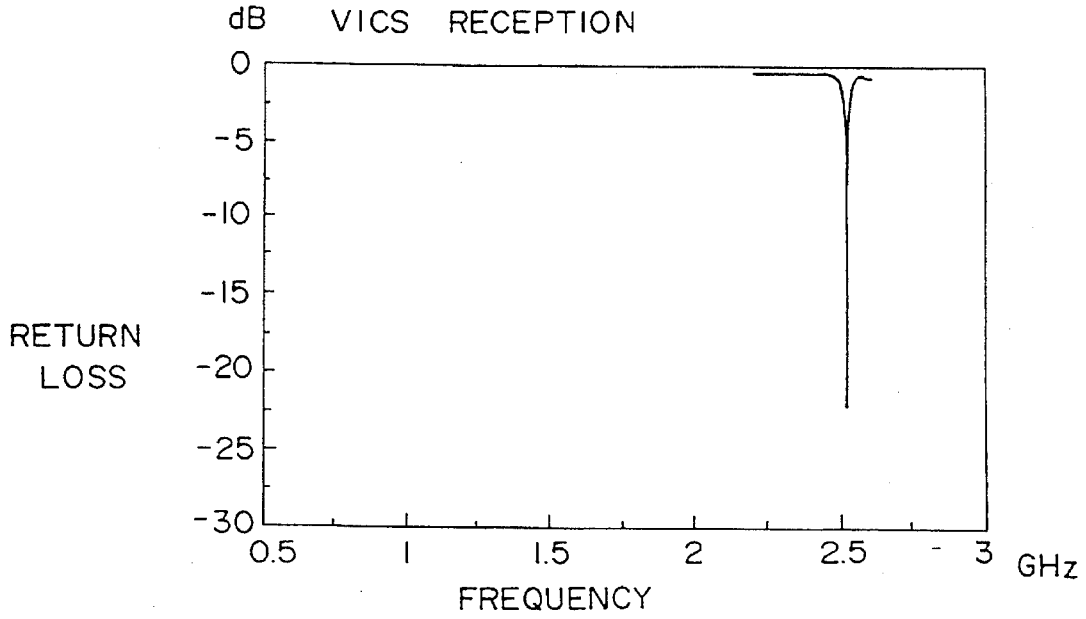
FIGS. 3(*a*) and 3(*b*) show graphs illustrative of the characteristics of the double-channel common antenna of the present invention under different operating conditions.
Figure 3:
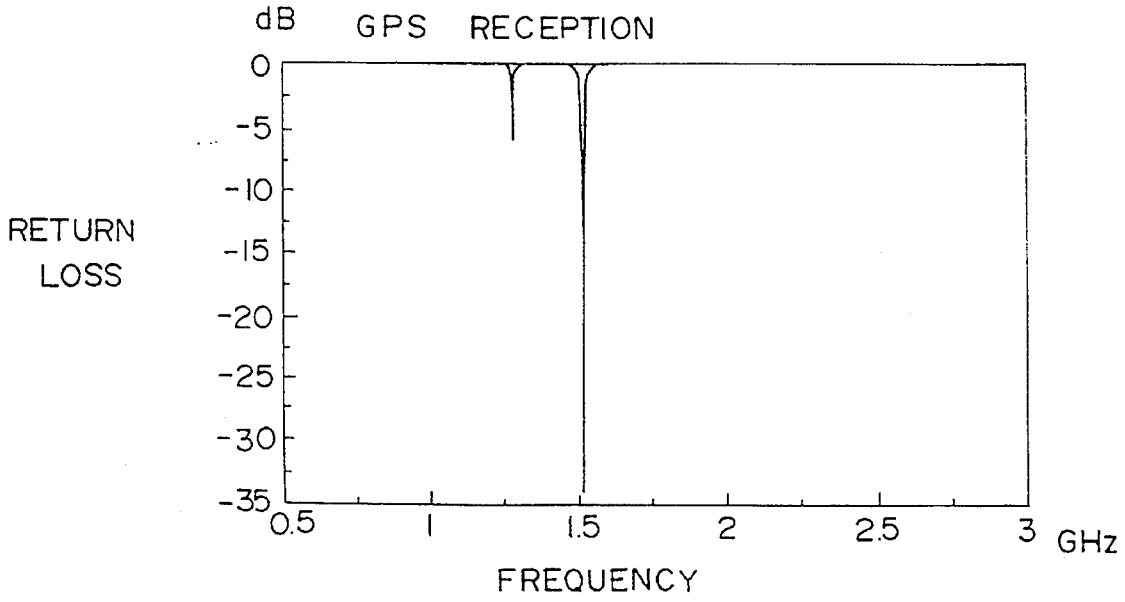

The characteristics of the double-channel common antenna configured as described above are shown in FIG. 3. FIG. 3(*a*) shows that the characteristic obtained for conductive pattern B exhibits a resonance point at 2.5 GHz, and FIG. 3(*b*) shows that the characteristic obtained for conductive pattern A exhibits a resonance point at 1.5 GHz. This shows that the same characteristics were obtained as those of the previous example, proving that the size of the element can be reduced by increasing the relative dielectric constant.

Looking at the mutual coupling between the elements of the double-channel common antenna described above, they are different according to the relative angles between the feed points, but, since the difference between the resonant frequencies is large, it can be controlled to −40 dB or less at a maximum. It has been confirmed that a variation of 60 dB can be achieved by varying the relative angles between the feed points but it has also been confirmed that a minimum of −100 dB or less is achieved at a relative angle of 90°.

When this antenna is used in practice for the GPS and VICS, since the GPS radio waves are circularly polarized, various methods could be used together, such as adding a degenerate separator element when power is supplied to the conductive pattern A at only one point, or causing a delay of a phase difference when power is supplied at two points, to ensure the resonance of circularly polarized radio waves.

Note that, when this antenna is used for the GPS and VICS, since the positions of the beacons are different, reception of the respective signals should preferably be made to have appropriate radiative patterns. For reception of GPS beacon in the 1.5 GHz band, broadcast from a satellite, the radiative pattern should preferably be $TM_{11}$ mode directed upward; but for reception of surface 2.5-GHz VICS beacon waves, it is necessary to use $TM_{01}$ mode since the radiant pattern in the horizontal direction is strong. The double-channel common antenna in accordance with the present invention can satisfy these requirements and can be adapted for reception of each type of beacon radio waves.

The above description has concerned an example that utilizes the 1.5-GHz GPS band and the 2.5-GHz VICS band, but it should be obvious to those skilled in the art that the antennas of the present invention can be adapted to other frequencies.

The present invention provides a double-channel common antenna that is compact, lightweight, and operates at two frequencies that are different. It also provides a double-channel common antenna in which the design of the individual elements is simple.

Since this is a small, low-profile antenna, it has the additional advantage that it can be mounted on the rooftop of an automobile or other vehicle.

What is claimed is:

1. A double-channel common antenna comprising:

a first radiant electrode provided in a circular annular shape on a first surface of a dielectric substrate, an edge surface on a central side of said first radiant electrode being short-circuited to a ground electrode formed on a second surface of said dielectric substrate; and a second circular radiant electrode provided within an inner edge of said first radiant electrode, a central portion of said second circular radiant electrode being short-circuited to said ground electrode, wherein said first and second electrodes are separately supplied with electrical power.

2. A double-channel common antenna according to claim 1, wherein said first and second electrodes operate in mutually different modes.

3. A double-channel common antenna according to claim 1, wherein said first electrode operates in $TM_{11}$ mode and said second electrode operates in $TM_{01}$ mode.

4. A double-channel common antenna assembly comprising:

a dielectric substrate having first and second surfaces;

a ground electrode formed on said second surface of said dielectric substrate;

a first radiant electrode provided on said first surface of said dielectric substrate in a circular annular shape, an edge surface on a central side of said first radiant electrode being electrically connected to said ground electrode;

a second circular radiant electrode provided within an inner edge of said first radiant electrode, a central portion of said second circular radiant electrode being electrically connected to said ground electrode;

first power means for supplying power to said first electrode; and second power means, separate from said first power means, for supplying power to said second electrode.

* * * * *